United States Patent [19]

Churchman

[11] Patent Number: 4,683,698

[45] Date of Patent: Aug. 4, 1987

[54] LOAD TRANSFER CLIP FOR ROOF PANEL SUPPORT TRUSSES

[75] Inventor: James E. Churchman, Roeland Park, Kans.

[73] Assignee: Butler Manufacturing Company, Kansas City, Mo.

[21] Appl. No.: 884,352

[22] Filed: Jul. 11, 1986

[51] Int. Cl.[4] ..... E04H 12/10; E04B 5/10

[52] U.S. Cl. ..... 52/655; 52/262; 52/283; 52/648; 52/714

[58] Field of Search ..... 52/655, 648, 262, 283, 52/714

[56] References Cited

U.S. PATENT DOCUMENTS

| | | | |
|---|---|---|---|
| 412,043 | 10/1889 | Sagendorph | 52/520 |
| 483,966 | 10/1892 | Montross | 52/520 |
| 3,032,153 | 5/1962 | Nerath | 52/655 |
| 3,313,082 | 4/1967 | Seborg et al. | 52/646 |
| 3,415,027 | 12/1968 | Snyder et al. | 52/650 X |
| 3,611,661 | 10/1971 | Chambers et al. | 52/262 X |
| 3,777,426 | 12/1973 | Weiner | 52/283 X |
| 3,913,296 | 10/1975 | Butts | 52/694 |
| 4,178,736 | 12/1979 | Salas | 52/655 X |
| 4,283,897 | 8/1981 | Thompson | 52/520 X |

FOREIGN PATENT DOCUMENTS

| | | | |
|---|---|---|---|
| 558909 | 1/1944 | United Kingdom | 52/648 |

*Primary Examiner*—Alfred C. Perham

*Attorney, Agent, or Firm*—Shoemaker and Mattare, Ltd.

[57] ABSTRACT

A delta-shaped roof joist structure provided with load transfer wall attaching clips at spaced intervals therealong for transferring both horizontal and perpendicular loads between the joist structure and a wall of a building. The load transferring clip structure includes a formed member of plate-like material having at one end a U-shaped portion for association and adjustment along a load transfer angle iron of an associated roof joist, and on the other end the member having an extension integral with one side of the U-shaped portion, and at substantially right angles thereto. The extension has an aperture for reception of wall affixing fastening elements therethrough.

14 Claims, 13 Drawing Figures

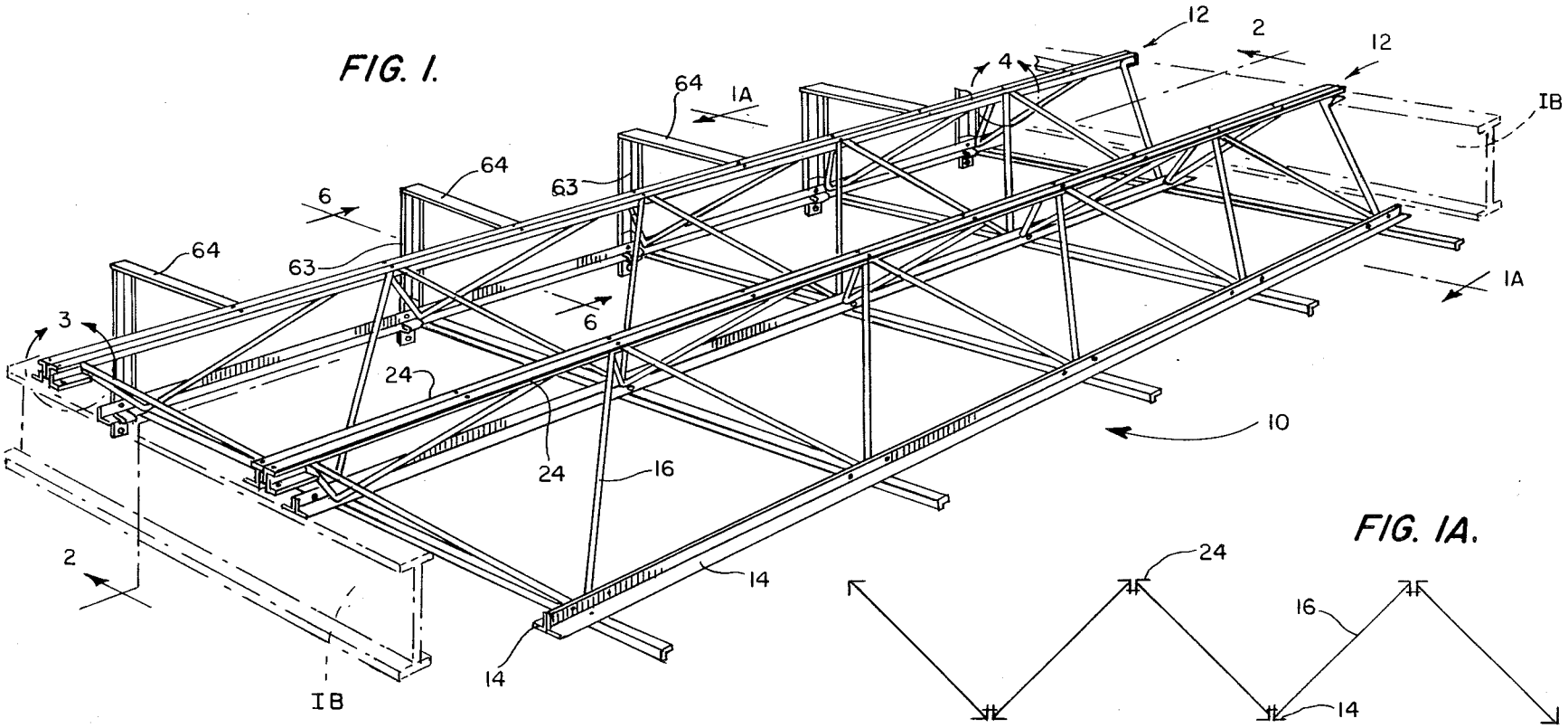
FIG. 1.
FIG. 1A.
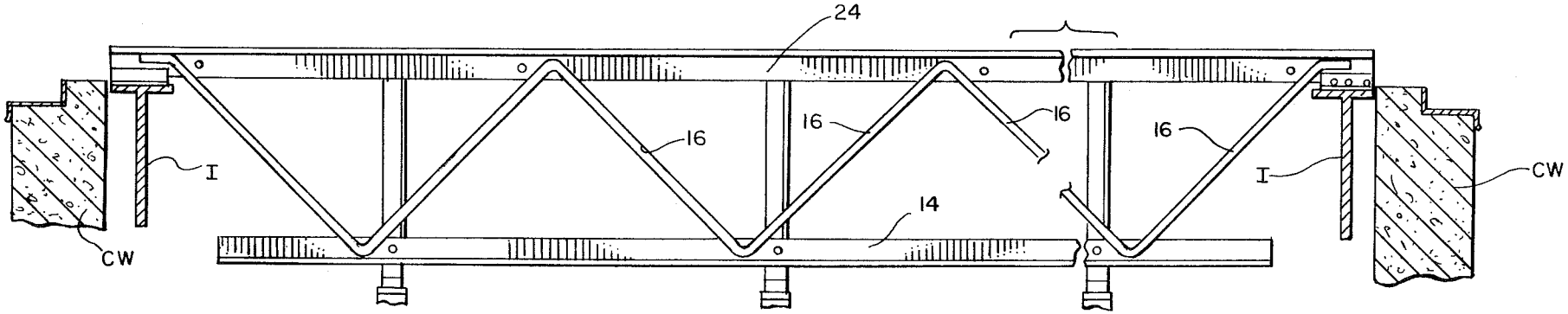
FIG. 2.

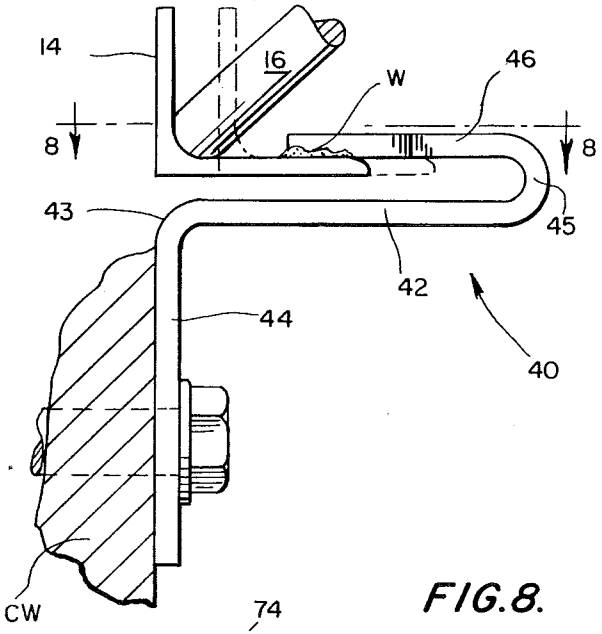
FIG. 7.
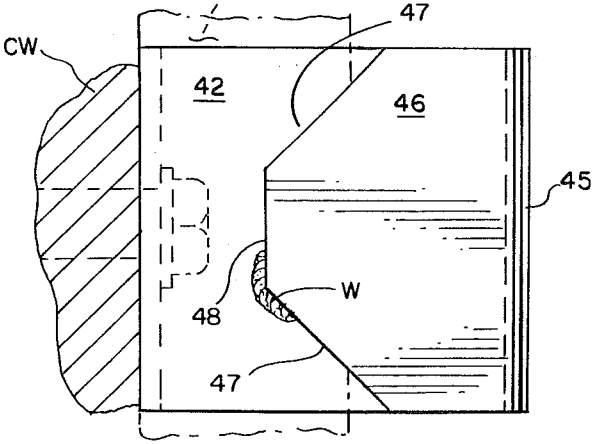
FIG. 8.
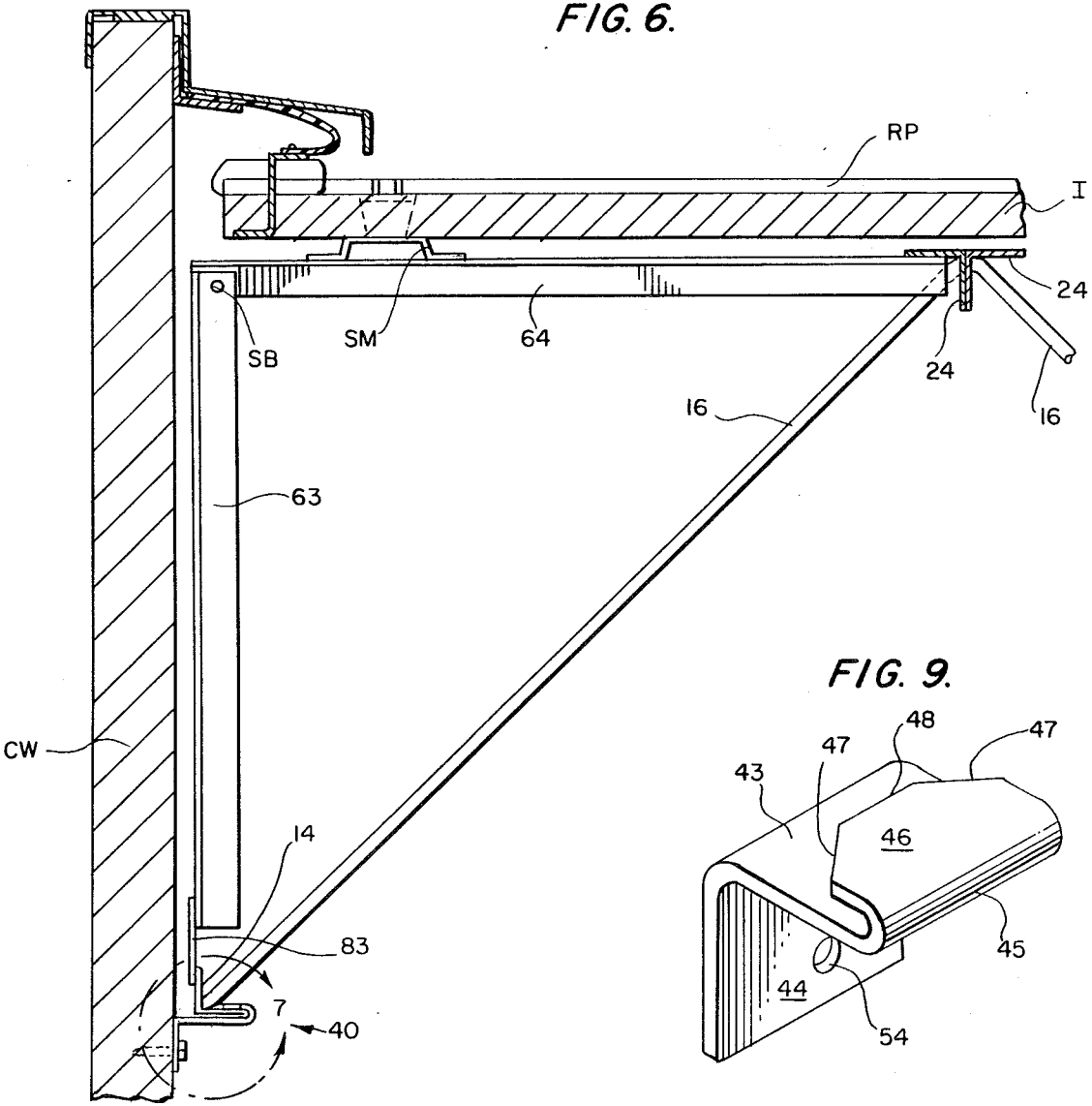
FIG. 6.
FIG. 9.

LOAD TRANSFER CLIP FOR ROOF PANEL SUPPORT TRUSSES

BACKGROUND OF THE INVENTION

1. Field of the Invention

This invention relates generally to roof trusses for supporting roof panels of a building during construction thereof, and especially for delta trusses with load transfer clips affixed thereto and to at least one wall of the building.

2. Description of the Prior Art

A common problem with known type devices for supporting roof panels is that they are either completely rigid and inflexible, and therefore do not permit sufficient thermal expansion of the associated roof panels without buckling thereof, or, in the case of support structure which does not permit expansion due to thermal changes, the structure fails to properly transmit horizontal loads both parallel and perpendicularly to the associated building support walls.

Existing prior patents which may be pertinent to the present invention are as follows:

| | |
|---|---|
| 3,226,904 | 1/4/66 |
| 3,313,082 | 4/11/67 |
| 3,415,027 | 12/10/68 |
| 3,893,276 | 7/8/75 |
| 3,913,296 | 10/21/75 |
| 4,178,736 | 12/18/79 |
| 4,282,619 | 8/11/81 |
| 4,438,616 | 3/27/84 |

These patents generally show various truss constructions for supporting roofs on buildings; however, they fail to teach the specific joist construction of the present invention, as well as lacking the load transmitting clip structure in combination therewith of the present invention. None of the prior art devices offer the new and novel features of the present invention.

SUMMARY OF THE INVENTION

An object of the present invention is to provide a load transmitting attachment clip for roof panel supporting joists for buildings.

Another object of the present invention is to provide an easily installed clamp for securing a load transmitting portion of roof panel support joists to a wall of the associated building.

A further object of this invention is to provide a clip structure having a U-shaped portion and an extension integrally therewith at substantially right angles thereto with an opening therethrough for quick and easy attachment of the clip to a building wall. The clip, once installed, is affixed to a load transfer member of a roof panel supporting joist of preferably delta construction for transmitting both parallel and perpendicular forces horizontally to the building wall.

A still further object of the present invention is to provide delta configured roof panel supporting joists having elongated upper and lower chords with angled connecting rods therebetween for supporting and affixing roof panels thereupon. A load transmitting clip is used to secure a load transmitting portion of the roof joists to at least one wall of the building.

The present invention has a number of new and novel features. A clip structure is provided for attaching a load transfer portion of roof panel supporting joists to at least one wall of the building under construction. The clip preferably has one end thereof shaped like a U, with the free end of the U having a tapered tip end. The clip is further provided with an integral extension at substantially right angles to the other end of the U-shaped portion. This extension is provided with an aperture therethrough near the mid-portion thereof for reception of wall affixing bolts or the like therethrough. The tapered end of the U-shaped portion can be appropriately welded to a longitudinal load transfer angle member as affixed to a portion of the roof panel supporting joist.

Preferably, each panel of the joist comprises an upper elongated chord member, a lower elongated chord member, and appropriate connecting web members therebetween at approximately 45° angles thereto. Each complete joist consists of two of these pairs of elongated chords and the appropriate angled connecting web. A plurality of the roof joists are connected to each other in angular relationship to form a delta configuration. Preferably, the upper chords of adjacent units are affixed together, and the lower chords of adjacent units are affixed together. The interconnecting of adjacent top and bottom chords forms a three dimensional structure of exceptional strength and stability. A plurality of these joists are normally used with a building. Along at least one wall of the building, the retaining clips are affixed so as to transmit loads of the joists to the wall and vice versa.

With this type construction, the expandable roof panel mounting clips of applicant's assignee, commonly referred to as MR-24 roof panel affixing clips, can be appropriately used. These clips permit thermal expansion of a roof panel as needed to prevent panel buckling, and/or other deformation of the overall structure.

The simple but unique method of attaching the overall joist system for supporting roof panels thereupon to the building walls appears to be new and novel. The specific load transfer clip of the present invention takes horizontal loads which are both perpendicular and/or parallel to the walls, and also permits variation in adjustability of construction grade tolerances, and is also sufficiently flexible to permit the supporting joist of preferably delta construction to take vertical large loads at the wall line without overstressing the individual members of the joist.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the present invention.

FIG. 1A is a schematic view of the joist system taken along line 1A—1A of FIG. 1.

FIG. 2 is a side elevational view taken generally along lines 2—2 of FIG. 1.

FIG. 6 is a side elevational view of a side of the joist of FIG. 1 taken along line 6—6 of FIG. 1.

FIG. 7 is an enlarged fragmentary portion inside elevation of the clip as installed and is taken along the double ended arrow circle 7 of FIG. 6.

FIG. 8 is a top plan view taken along lines 8—8 of FIG. 7.

FIG. 9 is a perspective view of the clip per se.

DESCRIPTION OF THE PREFERRED EMBODIMENT

Figure 3:
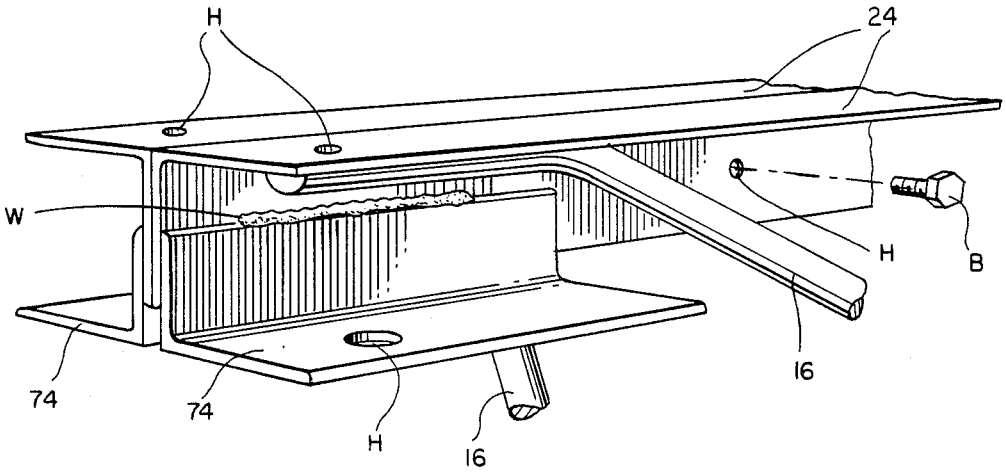
FIG. 3 is a perspective of a fragmentary portion of the top left end of FIG. 1 as indicated by the double arrow ended circle 3 on FIG. 1.

Referring to FIG. 1 of the drawing, reference numeral 10 indicates in general the present invention. Reference numeral 12 refers to a pair of delta joist structures as mounted upon supporting I-beams IB at each side of the building under construction. As best seen in FIG. 2, one-half of each truss comprises a lower chord member 14, an upper chord member 24, and diagonally angled web members formed from continuous rods 16 therebetween. The continuous diagonal rods 16 are preferably at approximately a 45° angle to the horizontal and are welded at the respective ends to the chord members 14 and 24 and at the contact points between the apices and the chord members 14 and 24. Thus, each individual joist has a plurality of triangular sections for strength and rigidity in the longitudinal direction. The individual joists are then connected to one another in an angular relationship of preferably 45°. FIG. 3 depicts the upper chord members 24 with the vertical portions of the respective angle members back-to-back or in engagement with each other. A fastener B is used to secure the two top chord members together when assembled. This fastener can be a bolt and nut or a SCRUBOLT TM. A plurality of such fasteners are suitably spaced along the longitudinal extent of the chord member 24. The lower chord angle members 14 have a vertical portion in back-to-back relationship with the vertical portion of the bottom chord of an adjacent truss and are connected in a manner similar to that described for the top chords. Such configuration is where the name delta joist is derived (see FIG. 1A).

Figure 4:
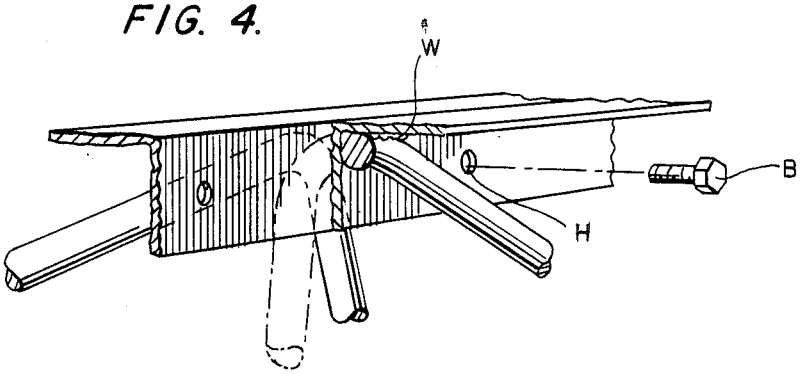
FIG. 4 is a perspective of a fragmentary portion of FIG. 1 as taken at the double ended arrows 4 thereon.

FIG. 4 depicts a mid-point of the upper chord member with the continuous undulating diagonal rods 16 being welded at the apex as appropriate to such midpoints and another attaching bolt B ready to go through holes H to secure the joists together.

As best depicted in FIG. 3, short attaching angle plates 74 are appropriately welded W to the respective extremities of the chord members 24. Appropriate holes H are provided in these plates for suitable attachment and securement thereof to the support I-beams IB.

Figure 5:
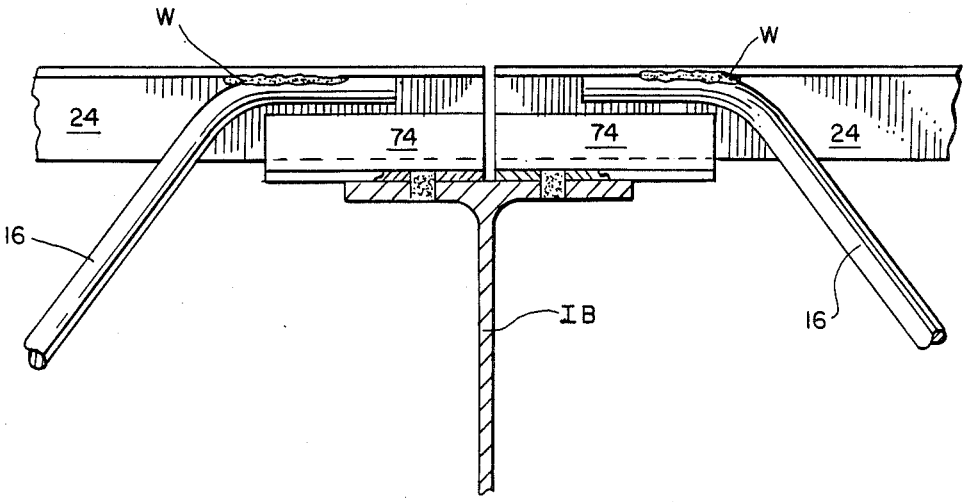
FIG. 5 is a side elevational view of two joists like that depicted in FIG. 3 end-to-end.

It should be noted that in some very long buildings each delta joist structure in single configuration is too short to span the entire building length. In such cases, two or more of the delta joists can be abutted end-to-end as depicted in FIG. 5. Another I-beam is suitably provided in the building construction for supporting and affixing the abutting joists as depicted in this figure.

While as depicted in FIG. 1 the respective extreme ends of the delta joists 12 are supported by the building I-beams IB at their respective ends, the furthermost joist which is adjacent a third building wall must be provided with some means for transferring shear loads to the wall. As best seen in FIG. 6, this structure comprises a horizontal support angle 64 and a vertical support angle 63 suitably connected at one end to each other by a bolt, such as SCRUBOLT TM SB. The vertical portion of a lower chord member 14 is affixed by welding end plate 83 to the lower end of the vertical angle 63. A spanning member SM at the top surface of horizontal support angle 64 supports the extremity of the roof panel insulation I and the roof panel itself RP closest to the outer wall CW. As indicated, suitable flashing F is also provided over the top of the wall and connected to the roof panel structure.

An important feature of the present invention is depicted by reference numeral 40. This refers to the load transfer clip comprising a horizontal portion 42 of a U-shaped end 46, 45. Extending from one end of the U-shaped portion is a bend 43 and an extension integral therewith 44. Extension 44 is substantially at right angles to the U-shaped portion and is provided with at least one opening 54 for reception of an attachment bolt or screw therethrough. FIGS. 7, 8 and 9 show the load transfer clip in greatest detail. Preferably, the free end of the U-shaped portion is chamfered or has diagonal portions cut out near the end thereof to provide angled surfaces 47 towards the tip edge 48. This is so suitable welding W can be used with a greater surface area than with a straight rectangular end. As best seen in FIG. 7, the lower support chord 14 has a certain flexibility relative to the clip during initial assembly and prior to the welding process taking place. Of course, once the chord joist 14 has been welded to the clip, then load forces, both parallel and perpendicular to the wall CW, can be transferred between the delta truss 12 and the load clip 40. In the use of the clip in the FIG. 6 showing, the roof panels end inside the concrete wall CW and surface or roof water drain-off must occur other than at the edge.

Figure 10:
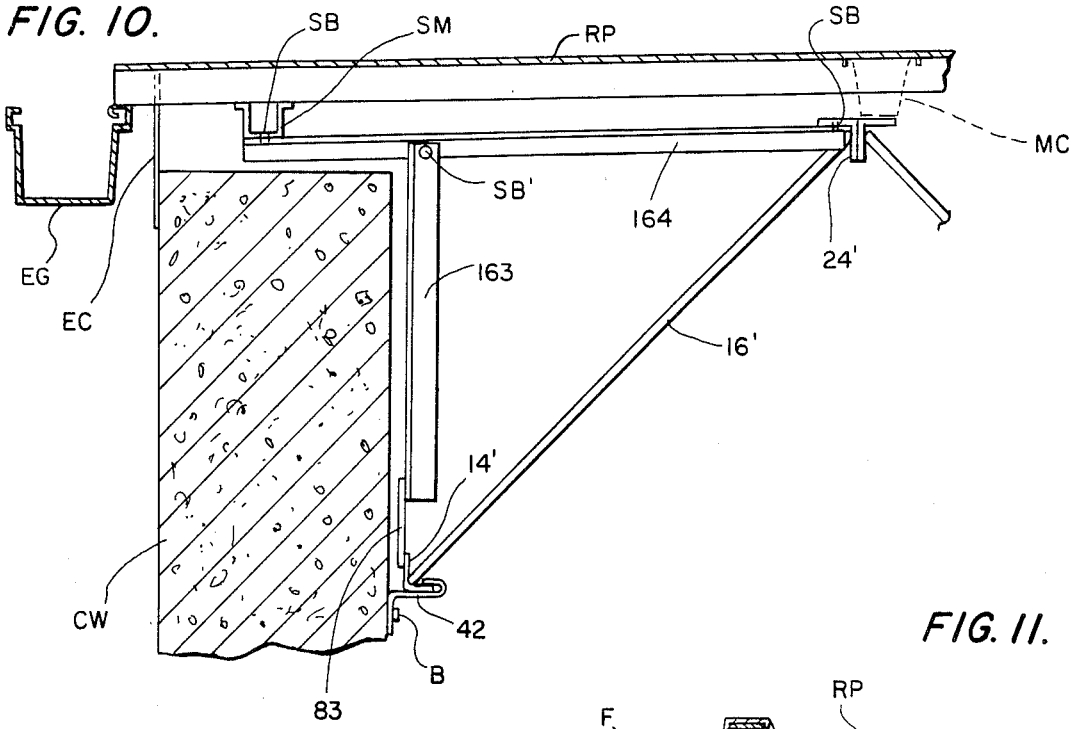
FIG. 10 is a modification of the clip load transfer attachment of FIG. 6.

However, in the modification of FIG. 10, the more conventional type roof construction is depicted, wherein the roof panels RP extend over the concrete wall CW and have an external gutter EG attached at the outer perimeter thereof. An eave closure EC preferably is also provided. Spanning members SM are provided on the extreme end of a cantilevered support angle 164, with the vertical support angle 163 forming the support for this cantilever structure. SCRUBOLTS TM SB′ preferably hold the two support angles together as in the FIG. 6 embodiment. Similarly, SCRUBOLTS TM SB are used at other points of the structure. Depicted in dotted lines is a roof panel attaching yoke Y which has the MR-24 roof panels double seamed with the attaching clip thereof.

Figure 11:
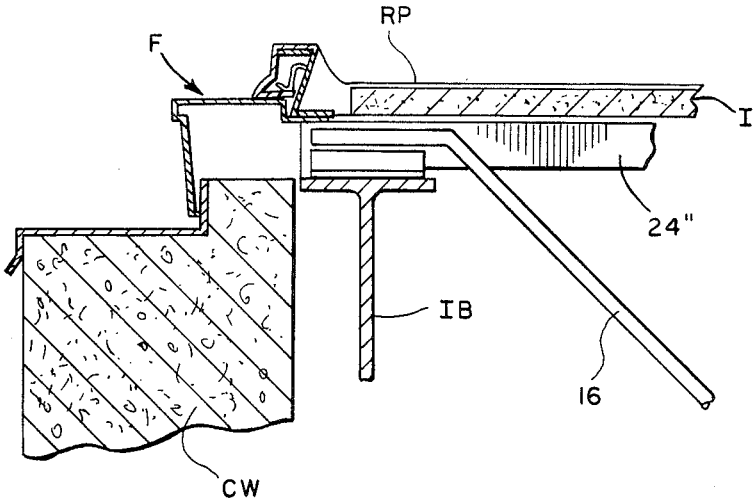
FIG. 11 is a modification of the joist support end as depicted in FIG. 2.

FIG. 11 shows a modification of the joist support end of the embodiment of FIG. 2. Again, the roof panel RP with suitable insulation I thereunder is supported upon the chord joist 24″ and suitable flashing F is provided between the outer perimeter of the roof panel and the concrete wall CW.

Figure 12:
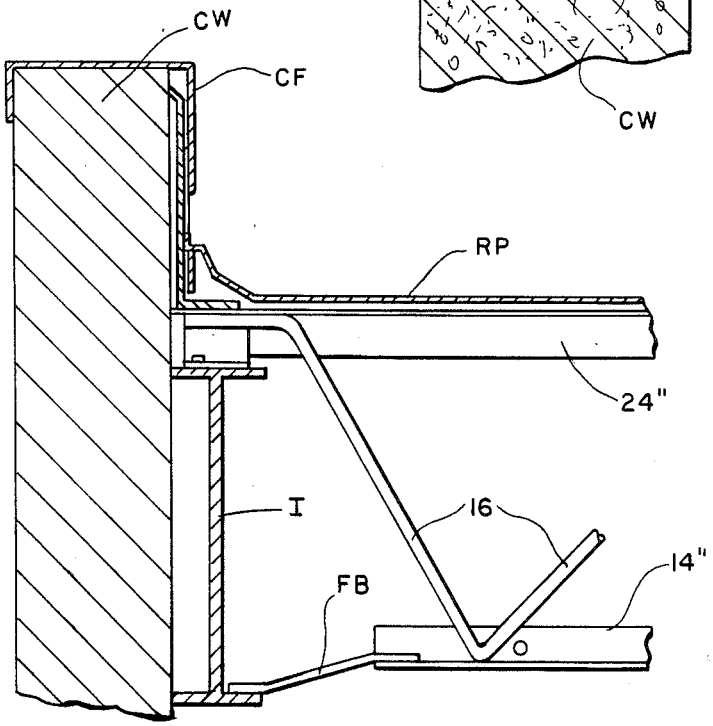
FIG. 12 is still another modification of the joist support end of FIG. 2.

Similarly, another modification of this structure is depicted in FIG. 12. A flange brace FB is provided in this embodiment between the lower flanges of the I-beam IB′ and the lower chord joist 14″.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

I claim:

1. A roof panel support apparatus comprising:

elongated joist means for mounting between walls of a building during construction thereof;

load transfer means with said elongated joist means for transferring shear loads;

clip means for attaching said load transfer means to at least one of said walls for transferring said shear loads between th joist means and the wall; and said clip means including a formed member of sheet material having a U-shaped reception portion on one end thereof for reception of said load transfer means.

2. The roof panel support apparatus defined in claim 1, wherein said loads being transmitted are substantially parallel to said wall.

3. The roof panel support apparatus defined in claim 1, wherein said loads being transmitted are substantially perpendicular to said wall.

4. The roof panel support apparatus defined in claim 1, wherein the other end of said plate member is at substantially right angles to the center plane of the U-shaped portion and is provided with a mounting hole therethrough.

5. The roof panel support apparatus defined in claim 1, wherein said joist means includes an upper chord member, a lower chord member, and angled connecting rods interconnecting same in triangular fashion.

6. The roof panel support apparatus defined in claim 5, wherein a plurality of said joist means are diagonally positioned with respect to each other and are connected at the upper and lower chords so that the overall combination forms a configuration of delta shape.

7. A clip for anchoring roof support joists to a wall of a building comprising:

a formed member of sheet plate material having a U-shaped portion at one end thereof, an extension portion integral with one side of said U-shaped portion, means in said extension portion for permitting quick attachment of said clip to a wall, said clip being combined with an elongated joist structure for supporting roof panels thereupon, and said elongated joist structure including a load transfer angle element for attachment to the U-shaped portion of the wall attaching clip.

8. The clip defined in claim 7, wherein said means for permitting quick attachment of said clip to a wall includes an aperture through said extension portion for receiving affixing elements therethrough.

9. The clip defined in claim 8, wherein the free end of said U-shaped portion is chamfered with angled surfaces towards the tip edge thereof.

10. The clip defined in claim 8, wherein said free end of said U-shaped portion has a tapered configuration thereto.

11. The clip defined in claim 7, wherein the free end of said U-shaped portion is chamfered with angled surfaces towards the tip edge thereof.

12. The clip defined in claim 7, wherein said free end of said U-shaped portion has a tapered configuration thereto.

13. The clip defined in claim 7, wherein said elongated joist structure comprises elongated upper chord members, elogated lower chord members, and angled interconnecting rods spaced between said upper and lower chord members and appropriately affixed thereto.

14. The clip defined in claim 7, wherein said load transfer angle element is attached to each clip by welding.

* * * * *